United States Patent [19]

Schindler

[11] 4,363,429

[45] Dec. 14, 1982

[54] POUCH FILLER NOZZLE AND VALVE

[75] Inventor: Peter V. Schindler, Northridge, Calif.

[73] Assignee: Angelus Sanitary Can Machine Company, Los Angeles, Calif.

[21] Appl. No.: 170,000

[22] Filed: Jul. 18, 1980

[51] Int. Cl.[3] ..... B67D 5/37; F16K 23/00

[52] U.S. Cl. ..... 222/504; 222/509; 222/571; 222/575; 251/333

[58] Field of Search ..... 137/242, 244; 141/10, 141/98, 317; 222/504, 547, 559, 571, 575, 509; 251/122, 324, 333

[56] References Cited

U.S. PATENT DOCUMENTS

| | | | |
|---|---|---|---|
| 2,156,518 | 5/1939 | Titus | 222/509 |
| 2,640,630 | 6/1953 | Genco | 222/559 X |
| 2,652,177 | 9/1953 | Lagemann | 222/509 |
| 3,131,433 | 5/1964 | Volland | 251/333 X |
| 4,161,971 | 7/1979 | Arzberger et al. | 222/509 X |

FOREIGN PATENT DOCUMENTS

| | | | |
|---|---|---|---|
| 2749186 | 5/1979 | Fed. Rep. of Germany | 222/504 |

*Primary Examiner*—Robert B. Reeves
*Assistant Examiner*—Edward M. Wacyra
*Attorney, Agent, or Firm*—Julian Caplan

[57] ABSTRACT

Filler nozzle and valve for products comprising high to low viscosity fluids, with or without suspended solids, particularly useful in filling pouch containers. The nozzle body has a vertical bore and also a side port entering the bore near its lower end at about a 60° angle. The valve piston reciprocates in the bore and seats at the bottom of the bore. Below the seating portion of the valve member is a concave-conoidal non-drip tip.

3 Claims, 9 Drawing Figures

POUCH FILLER NOZZLE AND VALVE

This invention relates to a new and improved filler nozzle and valve used with either low or high viscosity liquids, with or without solid particles suspended therein.

Heretofore various types of piston-type valves have been used for filling high viscosity liquids or solids suspended in high viscosity liquids. Similarly ball-type valves have been used for various types of products. On the other hand, the plug-rod or reversed plug-rod types of valves have been found suitable for liquids but not those liquids having suspended solids.

One of the advantages of the present invention is tfhat the nozzle and cut-off valve operate in such way as to allow filling low or high viscosity liquids or solid particles suspended in such liquids with reduced splashing of the product and a dripless, positive cut-off of flow with a self-cleaning action of the nozzle.

A further advantage of the invention is that it provides a narrow profile which is small enough to fit conveniently in the narrow gap of a pouch container opening. Nevertheless, the nozzle has sufficient internal clearance for the passage of solid particles.

The operation of the nozzle is such that the product is initially directed toward one of the walls of the pouch. Hence the velocity of flow decelerates by internal friction of the product. Accordingly, air entrapment in the product is reduced, splashing of the product is considerably reduced and contamination of the sealing area of the pouch is for practical purposes eliminated. p Further, as the flow continues, a whirlpool-like effect is created inside the pouch, decelerating the flow even more. This movement combined with a longer path of deceleration permits the product to be pumped at higher velocity. Accordingly the packaging equipment may operate at higher speed.

Another feature of the invention is the fact that at the end of the filling cycle sufficient force is applied to cut through solids which may be passing through the valve seating area, thereby positively closing the valve.

A still further feature of the invention is the fact that as the valve has closed the product and the valve piston have been travelling in the same direction. When the piston abruptly stops (upon seating), the inertia of the product causes it to continue to travel away from the valve. The shape of the tip of the piston is such that the remaining product on the tip is actually drawn upward by surface tension, rather than dripping and possibly contaminating the sealing area of the pouch.

Other objects of the present invention will become apparent upon reading the following specification and referring to the accompanying drawings in which similar characters of reference represent corresponding parts in each of the several views.

Figure 2:
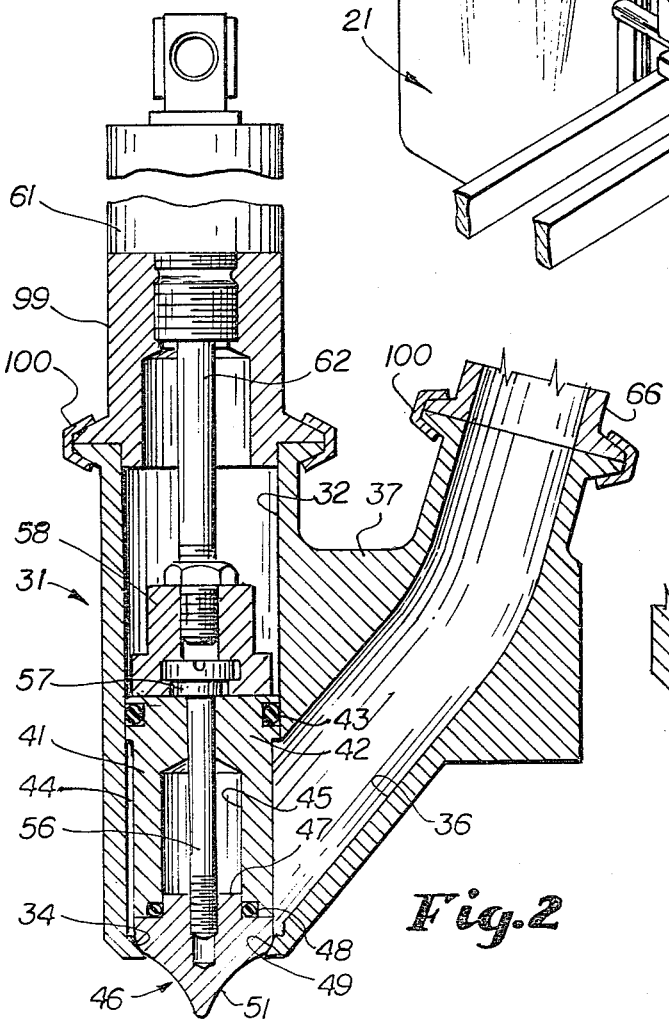
FIG. 2 is a vertical sectional view through the nozzle and valve, showing the valve in closed position, parts of the structure being broken away to conserve space.
Figure 2A:
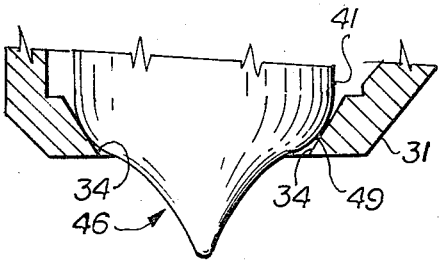
Figure 3:
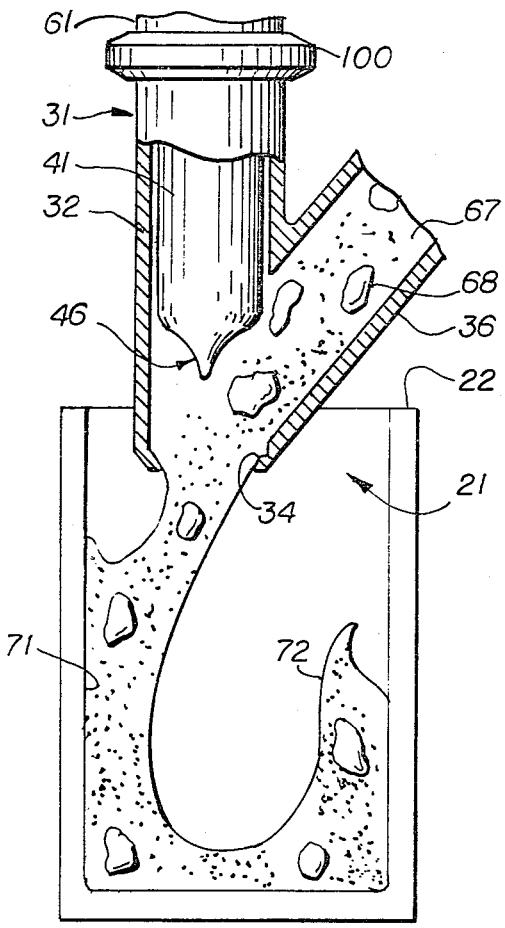

FIG. 2*a* is an enlarged fragmentary sectional view of a portion of FIG. 2;

FIG. 3 is a schematic view showing portions of the device at the commencement of filling a pouch;

FIG. 4 through 8, inclusive, are fragmentary views similar to FIG. 3 showing the device in various stages of its cycle of operation.

Figure 1:
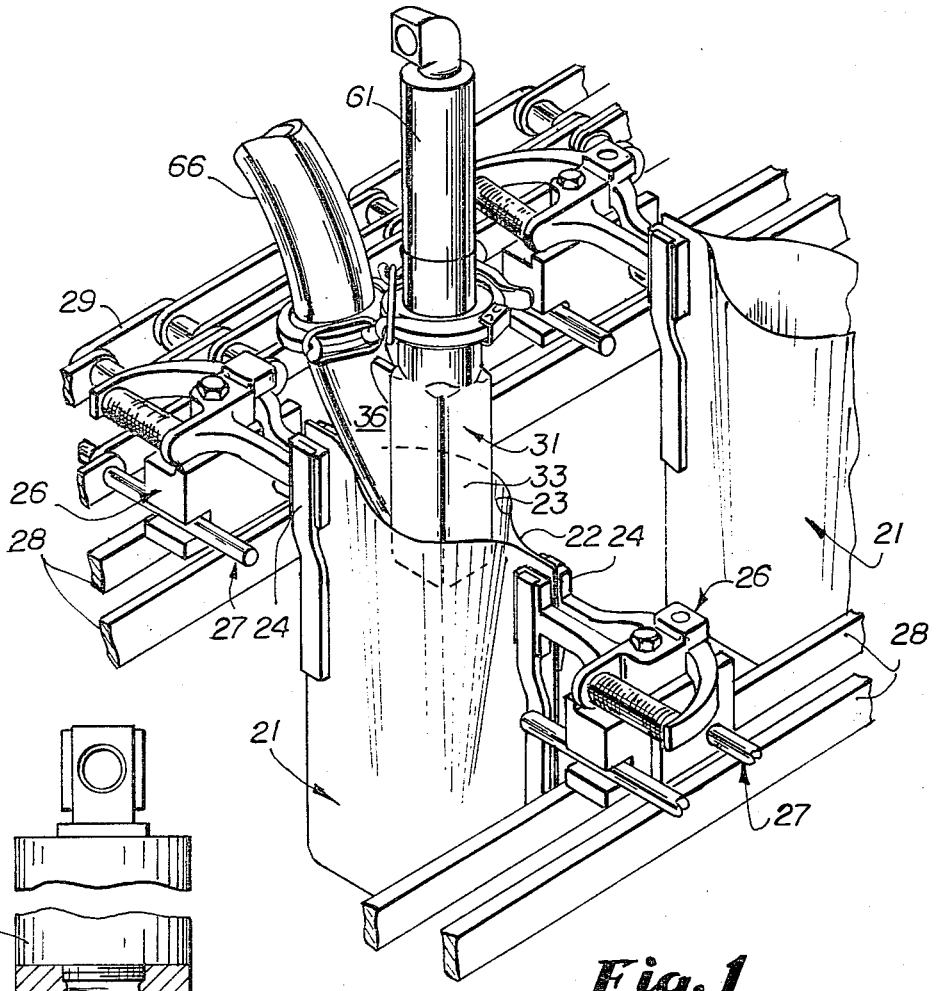
FIG. 1 is a fragmentary perspective view of the device shown in a stage of filling a plastic pouch, the pouch being held by conventional mechanisms.

As illustrated in FIG. 1, pouch 21 has open top edges 22 which, prior to reaching nozzle 31, has been forced apart to create a gap 23. The side edges of the pouch 21 are held by conventional grippers 24. The remaining mechanism shown in FIG. 1, is illustrated schematically and is of a type which is commercially available. Thus the grippers 24 extend inwardly from gripper carriers 26 which are guided by rails 28 on either side of the path of the pouch and are moved by chain 29 and extended rods 27 connected thereto, all as well understood in the art.

The body 31 of the nozzle and valve is supported from above in such manner that it can be moved downwardly and upwardly by means not illustrated but well understood in the art. Prior to the pouch 21 reaching the filling station illustrated in FIG. 1, grippers 24 have pushed the upper edges 22 apart to cause a gap 23 to enble the lower edge of the body 31 to be inserted in the gap. After the product has been filled, as hereinafter explained, the body 31 is elevated, permitting the pouch 21 to move on to subsequent stations.

An elongated cylindrical bore 32 which (as shown in FIG. 2) may have a square exterior 33 (shown in FIG. 1) fits into the gap 23. The lower end of body 31 is turned inward and has a conical seat 34 at the lower end of bore 32. Immediately above seat 34 is downward sloping side port 36 disposed at an angle of approximately 60° relative to the bore 32 and reinforced thereto by web 37. The product to be packaged is pumped or otherwise delivered through the port 36 and, when the valve is opened, through the seat 34, all as hereinafter explained.

Reciprocating in bore 32 is a piston or plunger 41 which has an enlarged diameter upper end 42 suitably grooved for a seal ring 43 which seals the piston 41 against the upper end of the bore 32. When the valve is fully closed, as shown in FIG. 2, the enlarged portion 42 is immediately above the side port 36. To reduce friction and to accommodate solids suspended in the liquid product the piston 41 may be formed with a reduced diameter portion 44 below the enlarged portion 42. Piston 41 preferbly is formed with a hollow 45 at its lower end.

Closing off the lower end of the piston 41 is a tip 46. Tip 46 at its upper end has a reduced diameter portion 47 fitting within the hollow 45 and also has a seal ring 48 which seals into a counterbore on the lower end of the hollow 45. Tip 46 is removable. It has a conical S-curved seat 49 which shears product in the gap between seats 34 and 49 and also seals when fully closed. The lower portion 51 of tip 46 is a concave conoidal shape and its outside surface generally is disposed at about a 45° angle relative to the axis of said tip, or a total included angle of about 90°. The shape of the lower portion 51 is important in reducing drippage, as hereinafter appears.

Rod 56 which fits through the piston 41 is threaded into the upper end of the tip 46 and at its upper end has a head 57 which is held in a plunger retainer 58 milled to receive head 57 in a quick-disconnect coupling well understood in the art and useful in disassembly for cleaning after use. Rod 56 secures retainer 58; piston 41; and tip 46 together.

Above body 31 is an actuator 61 connected to retainer 58 by stem 62. Actuator 61 is not illustrated or described herein since it is one of several types commercially available and well understood in this art. A preferred actuator 61 is a double acting pneumatic cylinder.

Quick-disconnect clamps 100 of type commercially available connect body 31 to actuator 61 and also connect port 36 to conduit 66.

OPERATION

At the commencement of operation the valve is closed as shown in FIG. 2. The body 31 is lowered into the gap 23 of pouch 21 and the piston 41 moves up relative to the body 31, the device assuming the position shown in FIG. 3. Product 67 is delivered by means of conduit 66 to the side port 36. As shown, the product 67 has suspended particles of solids 68 therein. The angle of port 36 relative to bore 32 directs the flow of product to one side—i.e., to the sidewall 71 of pouch 21. The position of piston 41 and shape of tip 46 also allow directing the flow to the side, as shown in FIG. 3. The flow decelerates by internal friction of the product and friction against the walls of pouch 21. This reduces entrapment of air in the product and also reduces splashing. It is important in the filling of the pouch 21 that the edges 22 not be contaminated because contamination thereof will reduce the effectiveness of the seal of the pouch. As is seen particularly in FIG. 3, contamination is effectively eliminated. The product reaching the bottom of the pouch 21 curves in a swirl 72, further decelerating the flow. By reason of the deceleration of the flow, higher filler velocities of product may be used, thereby resulting in higher speeds of packaging.

Figure 4:
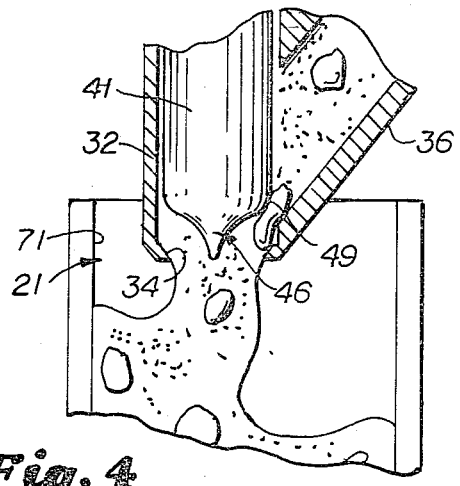

As filling reaches termination as shown in FIG. 4, the piston 41 moves downwardly towards the seat 34. Piston 41 blocks off portions of the side port 36 as it goes down and causes the fluid to change direction from the angular flow of FIG. 3 to the vertical flow of FIGS. 4, 5 and 6. There is sufficient force in the downward movement of the plunger with its combined kinetic energy to cut through any solids 68 which may be trapped as the plunger closes in the seating area 34.

Figure 5:
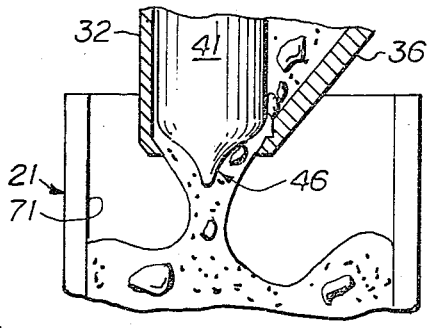

As the plunger closes as shown in FIGS. 4 and 5, the direction of flow of the product is directly downward rather than at an angle as shown in FIG. 3. The product 73 which adheres to the tip 46 is travelling at the same speed as the piston 41. Piston 41 stops suddenly when it seats on seat 34 and the product continues to travel downward. By virtue of inertia, most of the product is thrown downward away from the tip 46, as in drop 74.

Figure 6:
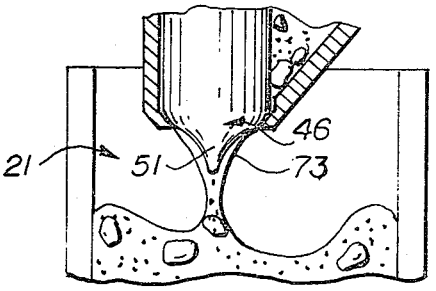
Figure 7:
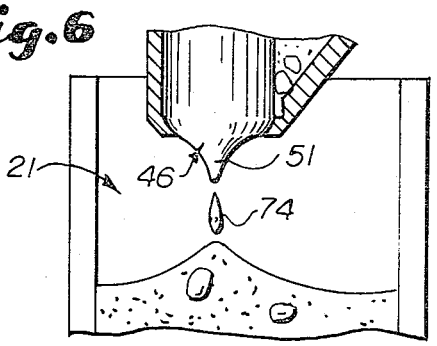
Figure 8:
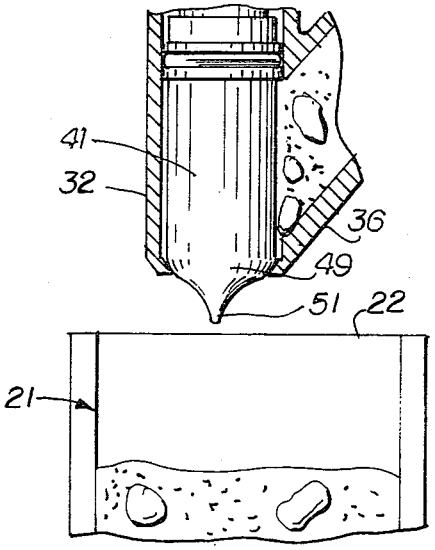

As shown in FIG. 8, the curvature 51 of the tip 46 not only directs the product to the center and downward as shown in FIGS. 5, 6 and 7, but also the remainder of the product which stays on the surfaces 51 does not drip off but is pulled upward by surface tension, reducing drippage. A dripp-free cut off of product results.

What is claimed is:

1. A nozzle and valve construction for filling product into containers comprising, a body having a cylindrical bore extending vertically of said body, said body being formed with a reduced diameter seat at its lower end, said seat being formed with a taper converging downwardly-inwardly in a conical shape, said body being formed with a side port for product slanting downwardly-inwardly and opening into said bore to one side of said body and in close proximity to said seat, a piston reciprocable in said bore from an open position substantially above said port to a closed position, said piston having a cylindrical, reduced diameter portion slightly smaller than said bore extending upward from its lower end to adjacent the top of said piston, and having an enlarged diameter portion in sliding-sealing engagement with said bore above said reduced diameter portion, said piston having a tip formed with a concve conoidal shaped lower portion merging with an upwardly-outwardly curved seating portion having a maximum diameter equal to said reduced diameter portion so that in cross-section said reduced diameter portion, said curved seating portion and said lower portion form a continuous S-curved shape, said tip terminating in a rounded lower end, there being approximately a 90° angle between two lines in a vertical plane through the axis of said piston, said lines interconnecting said lower end and said curved seating portion, said seating portion engaging said seat in closed position of said piston, and means to reciprocate said piston, the shape of said tip preventing drip of product after said valve is closed, whereby product is drawn upward along said S-shaped curve by surface tension of said product.

2. A construction according to claim 1, in which the angle of said port relative to said bore is about 60 degrees such as to discharge product downwardly and toward the side opposite said port when said piston is in open position.

3. A construction according to claim 2, in which said tip directs discharge of product generally downward as said piston approaches closed position.

* * * * *